US010745230B2

(12) United States Patent
Dettke et al.

(10) Patent No.: US 10,745,230 B2
(45) Date of Patent: Aug. 18, 2020

(54) WINDING DEVICE FOR WINDING A SUBSTANTIALLY INSULATING WEB MATERIAL

(71) Applicants: Hubertus Dettke, Trittau (DE); Christa Dettke, Trittau (DE); Christoph Dettke, Trittau (DE)

(72) Inventors: Hubertus Dettke, Trittau (DE); Christa Dettke, Trittau (DE); Christoph Dettke, Trittau (DE)

( * ) Notice: Subject to any disclaimer, the term of this patent is extended or adjusted under 35 U.S.C. 154(b) by 318 days.

(21) Appl. No.: 15/463,149

(22) Filed: Mar. 20, 2017

(65) Prior Publication Data

US 2017/0275115 A1 Sep. 28, 2017

(30) Foreign Application Priority Data

Mar. 23, 2016 (DE) ..... 20 2016 101 601 U

(51) Int. Cl.

| | |
|---|---|
| ***B65H 18/08*** | (2006.01) |
| ***B65H 18/16*** | (2006.01) |
| ***B41F 23/00*** | (2006.01) |
| ***B41F 13/70*** | (2006.01) |
| ***B41F 13/02*** | (2006.01) |
| ***B41F 21/00*** | (2006.01) |

(52) U.S. Cl.

CPC ..... *B65H 18/08* (2013.01); *B41F 13/02* (2013.01); *B41F 13/70* (2013.01); *B41F 21/00* (2013.01); *B41F 23/00* (2013.01); *B65H 18/16* (2013.01); *B65H 2301/5133* (2013.01); *B65H 2404/186* (2013.01); *B65H 2801/21* (2013.01)

(58) Field of Classification Search

CPC .. B65H 18/08; B65H 18/16; B65H 2404/186; B65H 2301/5132; B65H 2301/5133

See application file for complete search history.

(56) References Cited

U.S. PATENT DOCUMENTS

| | | | | |
|---|---|---|---|---|
| 2,445,271 A | | 7/1948 | Huebner | |
| 3,503,526 A | | 3/1970 | Crafton | |
| 4,402,035 A | * | 8/1983 | Kisler | H05F 3/04 361/213 |
| 5,205,212 A | | 4/1993 | Wolfe | |

(Continued)

FOREIGN PATENT DOCUMENTS

| | | |
|---|---|---|
| CH | 584 999 | 2/1977 |
| DE | 200935 | 8/1907 |

(Continued)

OTHER PUBLICATIONS

Machine Translation of DE 20 2014 103 084 U1, Nov. 12, 2015. (Year: 2015).*

(Continued)

*Primary Examiner* — William E Dondero

(74) *Attorney, Agent, or Firm* — Vidas Arrett & Steinkraus P.A.

(57) ABSTRACT

A winding device for a substantially electrically insulating web material having a winding roller on which the web material can be wound, characterized in that an apparatus exists for transferring an electric charge to the web material on the winding roller, and/or when deflecting to the winding roller, and the apparatus for transferring an electric charge is connected to at least one electrical high-voltage source with a positive or negative polarity.

9 Claims, 4 Drawing Sheets

(56) References Cited

U.S. PATENT DOCUMENTS

| | | | | |
|---|---|---|---|---|
| 2002/0179769 | A1 | 12/2002 | Dreckmann et al. | |
| 2007/0187020 | A1* | 8/2007 | Prittie | B65H 16/06 156/157 |
| 2008/0241718 | A1* | 10/2008 | Weber | B41F 16/00 430/48 |

FOREIGN PATENT DOCUMENTS

| | | | | |
|---|---|---|---|---|
| DE | 102011007136 | | 10/2012 | |
| DE | 202014103084 | U1 * | 10/2015 | B41F 31/08 |
| EP | 1914071 | A2 | 4/2008 | |
| EP | 1780011 | B1 | 6/2012 | |
| EP | 2990365 | | 3/2016 | |

OTHER PUBLICATIONS

Machine Translation of CH 584 999, Feb. 15, 1977. (Year: 1977).*
Machine Translation of EP 1 914 071 A2, Apr. 23, 2008. (Year: 2008).*

* cited by examiner

Prior Art

Prior Art

Prior Art

WINDING DEVICE FOR WINDING A SUBSTANTIALLY INSULATING WEB MATERIAL

The invention relates to a winding device for winding a substantially electrically insulating web material.

Winding devices for winding web material are used in particular in rotary printing presses in order to wind webs of printing substrate onto a roller.

In a printing unit of a rotary printing press, impression cylinders (also termed "plate cylinders") and counter-pressure cylinders (also termed "pressure rollers") roll in opposite directions against each other. A distinction is made between web-fed printing presses and sheet-fed printing presses depending if a web or sheet printing substrate is processed. With web-fed printing presses, the web printing substrate is drawn off by an unwinding roller and, after being printed, is either wound onto a winding roller, or divided by a cutting die into web sections, or respectively blanks, and the web sections, or respectively blanks, are stacked onto each other. The wound web printing substrate is then cut into sections, or respectively blanks, if applicable. In rotogravure, the impression cylinder absorbs ink from an ink trough into cells in its surface. The excess is then wiped off. The ink is applied to the printing substrate passing between the impression cylinder and counter-pressure cylinder.

Electrostatic assists improve the transfer of ink from the impression cylinder to the printing substrate and thereby increase the print quality. For this purpose, in the region of the printing nip between the impression cylinder and counter-pressure cylinder, an electrostatic field is generated that exerts a force on the ink in the cells of the impression cylinder, thus enhancing the transfer of the ink to the printing substrate and boosting the print quality.

With known electrostatic assists, the impression cylinder consisting of an electrically conductive material (such as metal) is grounded. The counter-pressure cylinder, or respectively pressure roller, has a (semi-) conductive layer on the circumference to which a high voltage is applied which generally has a negative polarity. The layer on the circumference is generally semi-conductive in order to minimize electric currents and prevent the production of sparks which could cause an ignition or explosion when working with solvent-based inks. In particular when working with water-based inks, a more conductive, or respectively highly-conductive layer can be used on the circumference of the pressure roller.

A semiconductive layer is understood to be a layer with high electrical resistance that strongly reduces the electric current but still lets a certain amount of electric current pass through. The electrical resistance of the layer is for example measured using a measuring setup having two parallel forks that each hold a leather strip about 8 cm long and about 1 cm wide that is wet with tap water (municipal water) so that the two parallel leather strips are about 10 cm apart. A length of 8 cm of the two parallel leather strips is wound around the outside of the layer. A measuring voltage of 1000 V is applied. With this measuring setup, resistances within a range of about 1 MΩ to 20 MΩ are measured in semiconductive layers that are particularly suitable for the present purpose. With more highly conductive layers, the resistances measured with this measuring setup are significantly lower, and with highly conductive layers, they are even much lower.

To transfer high-voltage to the pressure roller, e.g. charging electrodes are used which face the circumference of the pressure roller and release the charge to the (semi-) conductive layer on the circumference of the pressure roller, the (semi-) conductive layer being seated on an insulating layer (so-called "top loading"). The resistance of the insulating layer is preferably selected such that it enables a slow discharge of the pressure roller after the printing press is turned off. Particularly suitable insulating layers have a resistance within a range of about one to two gigaohms, measured with a device of the aforementioned type, wherein only one leather strip is wound around the outside of the layer, and the resistance is measured between the leather strip and machine ground.

Other charging electrodes are directed toward at least one end face of the pressure roller and discharge the charge to a conductive, or respectively highly-conductive layer under a (semi-) conductive layer that is exposed at an end face of the pressure roller (so-called "side charging"). Moreover, charging electrodes arranged at the end face are known that interact with a conductive plate on the end face of the pressure roller, the conductive plate being electrically connected to a (highly) conductive layer. The (highly) conductive layer below the (semi-) conductive layer produces an even distribution of the charge over the length of the pressure roller.

Also known are apparatuses for transferring the high voltage to an end face of the pressure roller that work according to the transformer principle. A fixed primary coil is arranged on the end face and is associated with a conjointly rotating secondary coil affixed to the end face of the pressure roller.

"Direct charging" is carried out for example using wiper contacts or brushes on the circumference or an end face of the pressure roller, or by electrically conductive roller bearings that bear a shaft of the pressure roller, or by means of which the pressure roller is mounted on an shaft, or by a fluid transfer system according to EP 1 780 011 B1, the entire contents of which is incorporated by reference. Preferably, the pressure roller in this case consists of a metal, electrically conductive material (such as steel) with a semi-conductive layer on the circumference.

The (semi-) conductive layer on the circumference of the pressure roller consists for example of rubber or polyurethane with embedded, electrically conductive particles (such as graphite). A (highly) conductive layer can also be made of rubber or polyurethane with a correspondingly greater amount of electrically conductive particles. It can, however, also be a metal layer. An insulating layer is for example also made from rubber or polyurethane, however with a correspondingly reduced number of electrically conductive particles, or without electrically conductive particles. In the case of sleeves, the sleeve (generally made of fiberglass-reinforced plastic) can simultaneously be the insulating layer.

Rotary printing presses generally have a plurality of sequentially-arranged printing units for transferring different inks to the printing substrate. Due to the electrostatic charging from electrostatic assists, a disadvantage is that the printing substrate can absorb very high charges which impairs subsequent processing. For example when transporting or cutting a roll comprising the printed printing substrate, flashover can occur that endangers the print workers. The charges are stored in the roll like a wound capacitor. Due to the high charges when the web printing substrate is cut to size and when working with sheets, problems can occur when stacking the blanks, or respectively sheets, and pulling apart individual blanks, or respectively sheets, as well as flashover that endangers the print workers. This is discernible when using paper as the printing substrate, and even more when using plastic film and composite materials that, for example, comprise plastic, paper and aluminum foils.

EP 1 914 071A, the entire contents of which is incorporated by reference, describes a rotary printing press with a plurality of printing units that are arranged sequentially in the throughput direction of the printing substrate and each have an impression cylinder and electrostatic assist associated therewith, wherein the electrostatic assists of at least two printing units have different polarities. Since there is at least one electrostatic assist with a negative polarity, and at least one electrostatic assist with a positive polarity, excessive charging of the printing substrate is counteracted, and undesirable discharges of the printed printing substrate is avoided along with endangerment of the print workers.

Undesirable charging of rolls consisting of substantially electrically insulating web material can moreover arise in reel slitters from unwinding and cutting films from master rolls and winding them onto secondary rolls. Moreover, this can occur when winding films in film extrusion machines and in laminators.

Against this background, the objective of the invention is to provide a winding device that further reduces undesirable charging of the web material.

The objective is achieved by an inventive winding device. Advantageous embodiments of the invention are specified in the dependent claims.

The winding device according to the invention for a substantially electrically insulating web material comprises a winding roller on which the web material can be wound, characterized in that an apparatus exists for transferring an electric charge to the web material on the winding roller, and/or when being deflected to the winding roller, and the apparatus for transferring an electric charge to the web material is connected to at least one electrical high-voltage source with a positive or negative polarity.

A substantially electrically insulating web material is for example a plastic film or a composite film that contains a plastic. The composite film contains the plastic for example in the form of a plastic film, or in the form of an overmolded layer, or in the form of applied plastic particles. Moreover, the composite film comprises for example a metal foil, or a paper web, or a cardboard web, or another plastic film. In addition, the composite film can comprise a plurality of any of the aforementioned components in combination. The web material is preferably a printing substrate.

The invention is based on the knowledge that charging the roll consisting of the web material can be best avoided or minimized when the charging of the web material is compensated by supplying a charge of opposite polarity by means of an apparatus for transferring an electric charge to the web material on the winding roller, and/or when deflecting to the winding roller so that the web material is nearly or completely discharged. Supplying the compensating charge to the web material on the winding roller, and/or when being deflected to the winding roller, prevents the web material from passing through a section before being wound in which it is recharged after the compensating charge supply, and creating a winding roller with undesirable charge.

According to a preferred embodiment, the apparatus for transferring an electric charge is connected to an electrical high-voltage source with a positive polarity. This compensates the generally negative charge of the web material before being wound onto the winding roller. The invention also relates to embodiments in which an electrical high-voltage source with a negative polarity is connected to the apparatus for transferring an electric charge to the web material.

According to a preferred embodiment, the web material is deflected onto the winding roller by an impression roller that rolls on the circumference of the winding roller, and by means of which the web material is deflected to the winding roller.

According to another embodiment, the deflection is carried out by an idler roller which is arranged at a distance from the winding roller and parallel thereto, by means of which the web material is guided to the winding roller, and/or the impression roller.

The apparatus for transferring an electric charge to the web material in the winding device can be realized in various ways. According to a preferred embodiment of the invention, the apparatus for transferring an electric charge to the web material comprises an impression roller which lies against the web material on the circumference of the winding roller in order to roll against it in the direction opposite that of the winding roller, wherein the impression roller has an electrically (semi-) conductive layer on the circumference, an apparatus exists for transferring an electric charge to the electrically (semi-) conductive layer of the impression roller, and the apparatus for transferring an electric charge to the (semi-) conductive layer is connected to the electrical high-voltage source. An impression roller is used for applying the electric charge to the web material on the winding roller. This can be an impression roller that is already used for tightly winding the web material onto the winding roller. Moreover, it can be a separate impression roller that serves to supply the electric charge to the web material and is positioned at a location on the circumference of the winding roller at which the web material already lies tightly against the winding roller for which there can be another impression roller.

According to one embodiment, the impression roller is designed like a pressure roller with a (semi-) conductive layer on the circumference. The designs of the pressure rollers at the beginning of this description correspondingly apply to the impression roller of the winding device. Moreover, the known apparatuses for transferring an electric charge to the pressure rollers can also be used for transferring an electric charge to the impression roller. The statements made at the beginning of this description about the application of an electric charge to the outer layer of the pressure roller by a top loading system, a side charging system (side loading) or a core charging system apply correspondingly to the charging of the impression roller.

According to another embodiment, the apparatus for transferring an electric charge to the web material is a charging electrode that is directed toward the web material on the circumference of the winding roller, and/or to the winding roller during deflection, as is the case with the above-described top-loading of a pressure roller.

According to another embodiment, the apparatus for transferring an electric charge to the web material is a directly charging apparatus with at least one electrically conductive brush lying against the web material on the winding roller, and/or the winding roller while deflecting, or a flexible, electrically (semi-) conductive tab that is connected to the electrical high-voltage source. This application of an electric charge is carried out on the circumference of a pressure roller as is the case with known direct charging.

According to another design, the impression roller or the charging electrode, or the direct charging apparatus is held by a movable holding device which is designed to move the impression roller, or needle electrode, or direct charging apparatus in a radial direction relative to the winding roller so that the distance between the impression roller, or the charging electrode, or the direct charging apparatus and the impression roller remains constant independent of the diameter of the wound web material. This promotes even discharging of the web material on the winding roller. The holding device preferably exists with an apparatus for transferring an electric charge to the web material by means of an impression roller. Alternatively, the changing circumference of the winding roller can be compensated by an impression roller that has an elastic layer, at least on the circumference. A movable holding device can be dispensed with in particular when the charge is supplied by a charging electrode or a direct charging apparatus to the web material on the winding roller. The varying circumference of the winding roller can if applicable be compensated by a changing voltage in the charging electrode, or by the flexibility of the brushes, tab, or other direct charging apparatus.

According to another embodiment, the apparatus for transferring an electric charge is an idler roller by means of which the web material is supplied to the winding roller, the idler roller has an electrically (semi-) conductive layer on the circumference, there is an apparatus for transferring an electric charge to the electrically (semi-) conductive layer of the idler roller, and the apparatus for transferring an electric charge to the (semi-) conductive layer of the idler roller is connected to the high-voltage source. In this embodiment, the idler roller can be designed like a pressure roller described at the beginning of the description. The apparatus for transferring an electric charge to the (semi-) conductive layer of the idler roller can be designed as a top-loading system, a side-loading system, or a core charging system for a pressure roller as described at the beginning of the description.

According to another embodiment, the winding device has an idler roller that is arranged at a distance from the winding roller which has a rotary axis that is arranged parallel to the rotary axis of the idler roller so that the web material is deflected by the idler roller to the impression roller, and is pressed by the impression roller against the circumference of the winding roller. In this embodiment, the web material is wrapped around a particularly large part of the circumference of the impression roller. Preferably, the electric charge for compensating the charge of the web material is applied by the impression roller. It can however also be applied by the idler roller. Given the large wrapping, the compensating charge is applied in a particularly effective manner.

According to another embodiment, the apparatus for transferring an electric charge to the web material is connected by a switching apparatus to a high-voltage source with a positive polarity, and a high-voltage source with a negative polarity. With this design, the compensating charge can be supplied with a positive polarity or negative polarity depending on the charge of the web material.

According to another embodiment, the switching apparatus comprises means for delayed switching so that, when switching from a high-voltage source with one polarity to a high-voltage source with another polarity, voltages with a different polarity are not simultaneously applied to the apparatus for transferring an electric charge to the web material.

According to another embodiment, the high-voltage source supplies an adjustable high voltage to the apparatus for transferring an electric charge to the web material. In this embodiment, the level of the high voltage can be adjusted depending on the charge of the web material in order to better neutralize the charge of the web material.

According to another design, there is at least one field strength measuring apparatus with a detection range through which the web material is moved on the winding roller, and/or toward the winding roller while being deflected, wherein the field strength measuring device measures the charge that the web material has and is connected to at least one control apparatus that is connected to the high-voltage source and/or the switching apparatus in order to apply a high-voltage of a specific level and/or polarity, depending on the charge of the web material measured by the field strength measuring apparatus, to the apparatus for transferring an electric charge to the web material. With this embodiment, the level and/or polarity is adjusted of the high-voltage for compensating the charge of the web material. According to a preferred embodiment, the control apparatus is designed so that it applies a high-voltage at a level and/or polarity to the apparatus for transferring an electric charge which causes a minimum charging of the web material wound on the winding roller.

According to a preferred embodiment, a field strength measuring device is arranged on the circumference, or at least on an end face of the winding roller.

According to another design, the winding device is an alternating winding roller device. With an alternating winding roller device, there are two winding positions in which the web material is alternatingly wound on a winding roller. An alternating roller device is designed so that when a winding roller is completely wound, the subsequent web material is cut off and wound onto the other winding roller. To this end, the completely wound winding roller is swung out of the winding position and removed from the winding device, and a new winding roller to be wound is wound in the winding position.

According to another design, the winding device is a component of a rotary printing press, or respectively a web-fed printing press. According to another embodiment, it is a gravure printing press, flexographic printing press, offset printing press, letterpress printing machine, planographic printing press or a screen printing machine.

According to another embodiment, the winding device is a part of a reel slitter.

According to another embodiment, the winding device is a part of a film extrusion machine.

According to another embodiment, the winding device is a part of a laminator.

Moreover, the winding device according to the invention can be used in other applications in which web material consisting of substantially electrically insulating material is wound in a roll.

The invention will be further explained with reference to the accompanying drawings of exemplary embodiments. In the drawings:

In the following explanation of different exemplary embodiments, correspondingly designated components are provided with the same reference numbers.

FIGS. 1 to 3 are exemplary embodiments of rotary printing presses with electrostatic assists that can be retrofitted with the winding device according to the invention. FIGS. 1 to 3 do not describe the invention but rather are only for better understanding the technical background of the invention.

Figure 1:
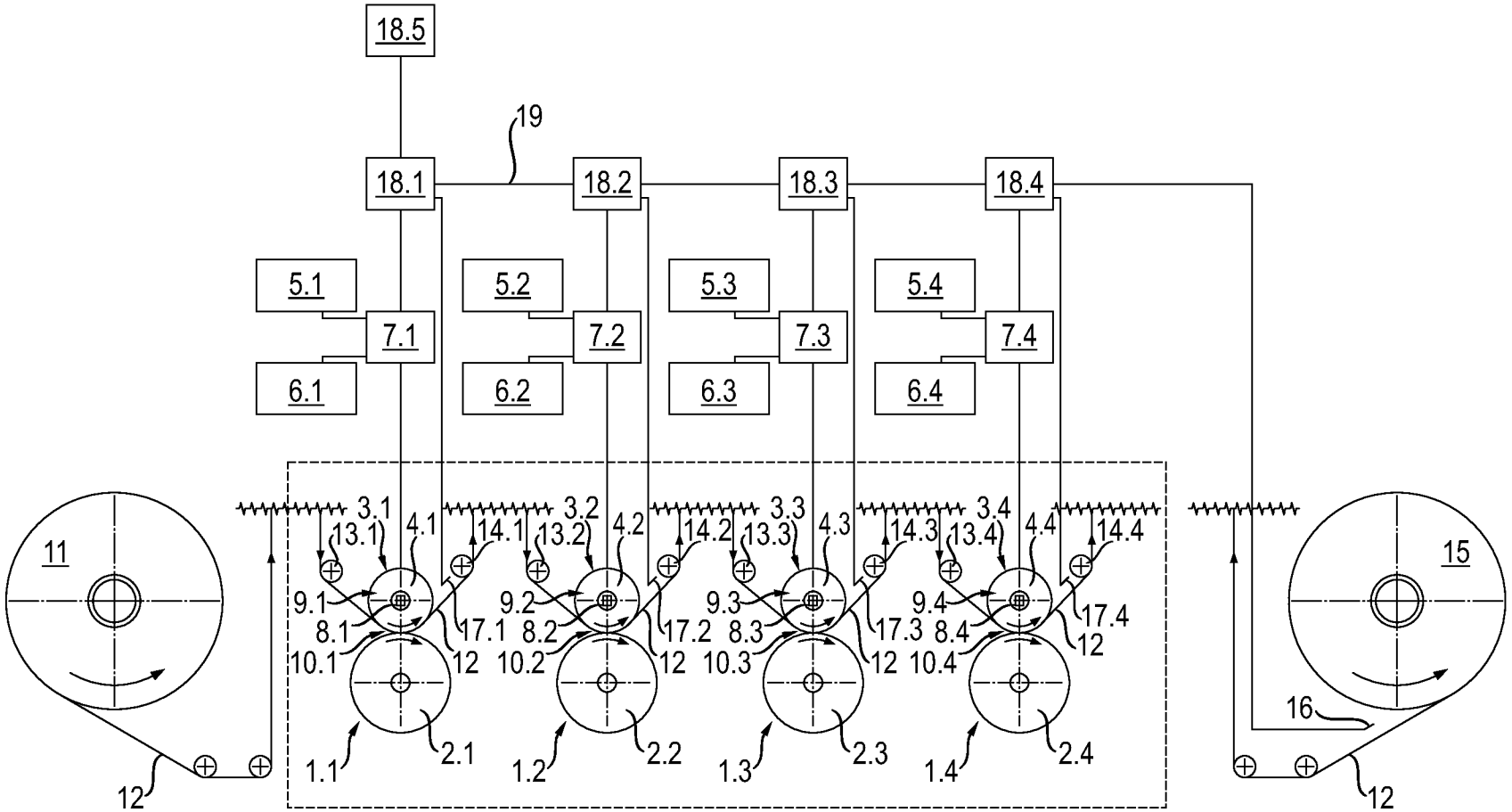
FIG. 1 shows a highly schematic view of a rotary printing press with a plurality of print units and high-voltage sources with different polarities switchably assigned thereto.

According to FIG. 1, a rotary printing press has four sequentially arranged print units 1.1 to 1.4. Each print unit 1.1 to 1.4 has a metal, electrically conductive impression cylinder 2.1 to 2.4 that is electrically grounded by electrically conductive bearings. Moreover, each print unit 1.1 to 1.4 has an electrostatic assist 3.1 to 3.4.

Each electrostatic assist 3.1 to 3.4 has a pressure roller 4.1 to 4.4 which is a counter-pressure cylinder that rolls on the impression cylinder 2.1 to 2.4. Moreover, each electrostatic assist 3.1 to 3.4 has a high-voltage source with a positive polarity 5.1 to 5.4 and a high-voltage source with a negative polarity 6.1 to 6.4. The high voltage of each high-voltage source 5.1 to 5.4 and 6.1 to 6.4 is preferably adjustable.

Each print unit 1.1 to 1.4 comprises a switching apparatus 7.1 to 7.4, wherein each switching apparatus 7.1 to 7.4 is connected to a high-voltage source with a positive polarity 5.1 to 5.4 and a high-voltage source with a negative polarity 6.1 to 6.4.

Each switching apparatus 7.1 to 7.4 is connected via an apparatus for transferring an electric charge 8.1 to 8.4 to a (semi-) conductive layer of the pressure roller 4.1 to 4.4 of the same print unit 1.1 to 1.4. Each pressure roller 4.1 to 4.4 together with the apparatus for transferring an electric charge 8.1 to 8.4 forms an apparatus for generating an electrical field 9.1 to 9.4 in the printing nip 10.1 to 10.4 between the impression cylinder 2.1 to 2.4 and pressure roller 4.1 to 4.4.

From an unwinding roller 11, a printing substrate 12 is guided between the impression cylinders 2.1 to 2.4 and pressure rollers 4.1 to 4.4 of sequential print units 1.1 to 1.4. Between each print unit 1.1 to 1.4 are idler rollers and/or compensation rollers 13.1 to 13.4 and 14.1 to 14.4 by means of which the printing substrate 12 is carried away. After the print units 1.1 to 1.4, the printing substrate 12 is guided to a winding roller 15.

A field strength sensor 16 is arranged next to the printing substrate 12 directly before it is wound on the winding roller 15.

Moreover, another field strength sensor 17.1 to 17.4 is arranged after each print unit and is assigned to the printing substrate 12 on an idler roller 14.1 to 14.4.

Each print unit 1.1 to 1.4 has a control apparatus 18.1 to 18.4 for controlling the electrostatic assist 3.1 to 3.4. The control apparatuses 1.1 to 1.4 are connected to each other by a data bus 19.

Moreover the control apparatuses 18.1 to 18.4 are connected by the data bus 19 to a main control 18.5.

The field strength sensor 16 is connected by the data bus 19 to the control apparatuses 18.1 to 18.5.

Each additional field strength sensor 17.1 to 17.4 is connected to the control apparatus 18.1 to 18.4 of the same print unit 1.1 to 1.4 and/or to the data bus 19.

When the rotary printing press is operating, the printing substrate 12 is wound off of the unwinding roller 11, guided through the print units 1.1 to 1.4 and wound onto the winding roller 15. It is printed with various inks in the print units 1.1 to 1.4.

The switching apparatuses 7.1 to 7.4 are controlled by the control apparatuses 18.1 to 18.4 so that a high voltage with a positive polarity is applied to the last used print unit 1.4 in the throughput direction. The polarities of the high-voltages supplied to the print units 1.1 to 1.3 used upstream in the direction of throughput are adjusted by the control apparatuses 18.1 to 18.4 so that the field strength sensor 16 measures a minimum charge of the printing substrate 12 before the winding roller 15. For this purpose, for example, the print units 1.1 and 1.3 are supplied with high voltages with a negative polarity, and the print unit 1.2 is supplied with a high voltage with a positive polarity.

Figure 2:
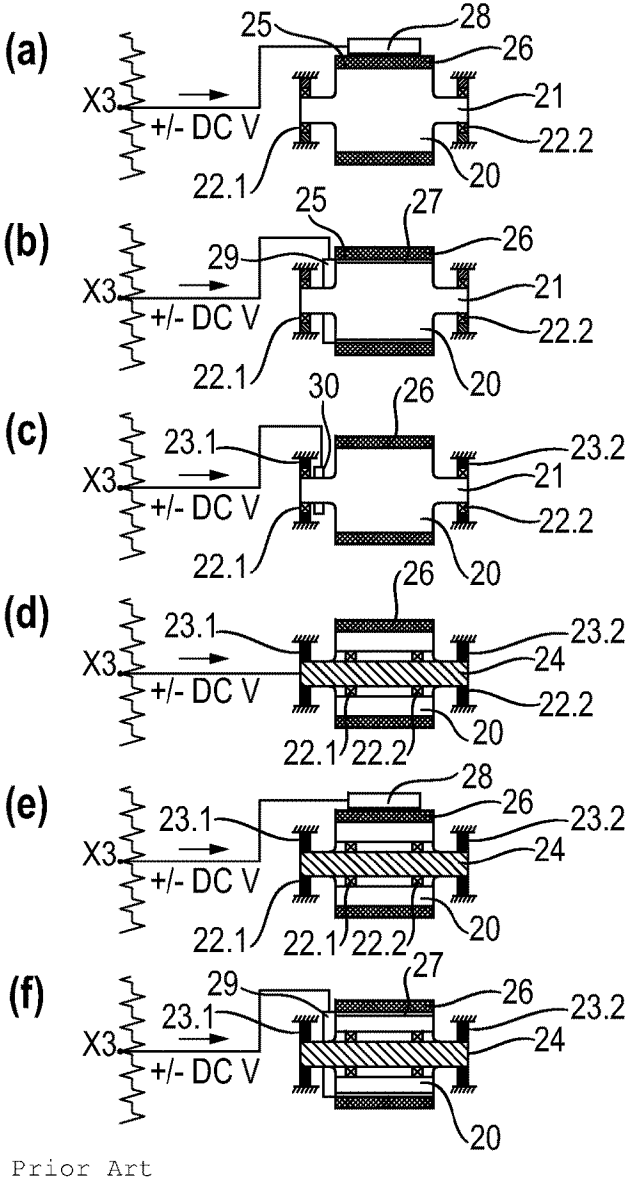
FIG. 2 shows a highly schematic view of high-voltage generators with different polarities having switching apparatuses and pressure rollers with different charging systems.
Figure 2:
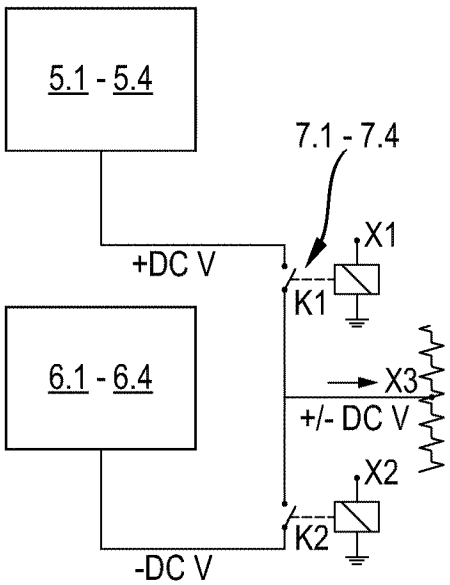

According to FIG. 2 the apparatus for transferring an electric charge 8.1 to 8.4 to the (semi-) conductive layer of the pressure roller 4.1 to 4.4 can be designed differently. All of the designs have a pressure roller 4.1 to 4.4 with a metal core 20. With the designs in FIG. 2*a* to *c*, the core has a rotating shaft 21 which is borne in roller bearings 22.1, 22.2. With the designs in FIGS. 2*a* and *b*, the roller bearings 22.1, 22.2 are grounded. With the design according to FIG. 2*c*, the roller bearings 22.1, 22.2 are separated from the ground by insulations.

With the designs in FIG. 2*d* to *f*, the metal core 20 is borne by roller bearings 22.1, 22.2 on a fixed shaft 24. The shaft 24 is held in insulation elements 23.1, 23.2 and insulated from ground.

With the design in FIG. 2*a*, an insulating layer 25 is arranged on the outside of the outer circumference of the metal core 20. A (semi-) conductive layer 26 of the pressure roller 4.1 to 4.4 is seated directly on the outside of the insulating layer 25.

With the design in FIG. 2*b*, an insulating layer 25 is arranged on the outer circumference of the metal core 20, an electrically highly-conductive layer 27 is arranged on the outer circumference of the insulating layer 25, and the (semi-) conductive layer 26 of the pressure roller 4.1 to 4.4 is seated on the outer circumference of said highly-conductive layer. With the design in FIG. 2*f*, an electrically highly-conductive layer 27 is arranged on the outer circumference of the metal core 20, and the (semi-) conductive layer 26 of the pressure roller 4.1 to 4.4 is seated on the outer circumference of the highly-conductive layer 27.

With the design in FIG. 2*a*, the electric charge is supplied by a needle electrode 28 from the outside to the layer 26 of the pressure roller 4.1 to 4.4 (top loading). The insulating layer 25 prevents the charge from flowing to ground.

In FIG. 2*b*, the charge is supplied via the one charging electrode 29 to an end face of the pressure roller 4.1 to 4.4 to the electrically highly-conductive layer 27 (side loading), and is evenly distributed from there over the inside of the layer 26. The insulating layer 25 prevents a discharge to ground here as well.

In FIG. 2*c*, the high voltage is supplied via the shaft 21 (core charge loading), for example by means of a fluid transfer system 30 according to EP 1 780 011 B1, or by means of brushes. By means of the metal core 20, the charge is evenly distributed to the inside of the layer 26. The insulation elements 23.1, 23.2 prevent a discharge to ground.

With the design in FIG. 2*d*, the charge is supplied by the fixed shaft 24 and the roller bearings 22.1, 22.2 to the metal core 20 (core charge loading). The charge is distributed evenly to the layer 26 over the outer circumference. Here as well, the insulation elements 23.1, 23.2 prevent discharge of the charge to ground.

In FIG. 2*e*, the charge of the layer 26 is in turn supplied by a needle electrode 28 (top loading). In this case, the insulation elements 23.1, 23.2 prevent a discharge to ground.

According to FIG. 2*f*, the charge in turn is supplied by a charging electrode 29 to an end face of the highly-conductive layer 27 (side loading). In this case the insulation elements 23.1, 23.2 prevent the charge from draining to ground. In this design, one of the insulations can be dispensed with.

According to FIG. 1, the pressure roller 4.1 to 4.4 and the apparatus for transferring the electric charge 8.1 to 8.4 are designed like in FIG. 2*c* or *d*.

Figure 3:
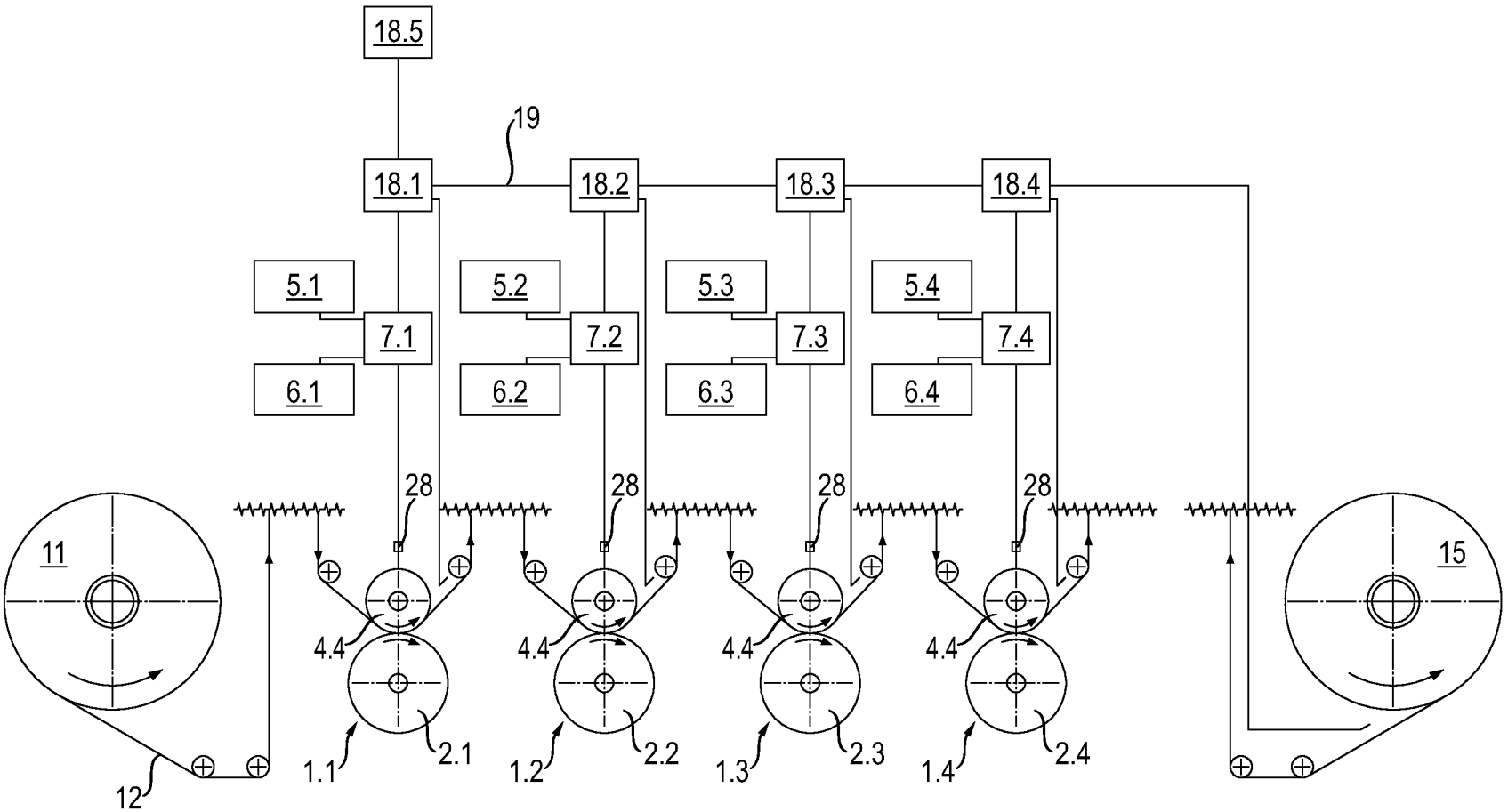
FIG. 3 shows a highly schematic view of an alternative rotary printing press.

The rotary printing press in FIG. 3 differs from the one in FIG. 1 in that the pressure rollers 4.1 to 4.4 and the apparatuses for transferring the electric charge 8.1 to 8.4 are designed as in FIG. 2*a* or 2*e*.

Figure 4:
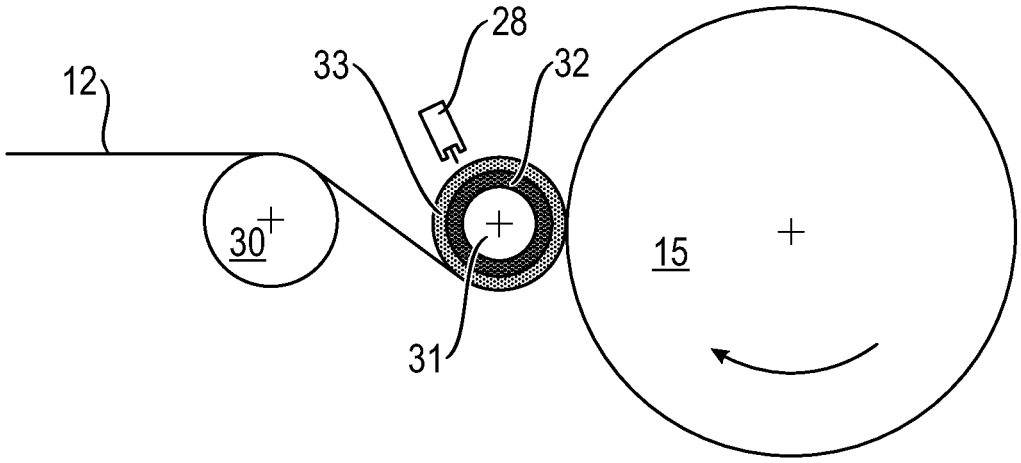
FIG. 4 shows a highly schematic view of a winding device according to the invention with an impression roller with a top loading system.

According to FIG. 4, a winding device according to the invention has an idler roller 30 by means of which the web material (printing substrate) 12 is deflected to an impression roller 31. The web material 12 is fed to a winding roller 15 by the impression roller 31.

On the circumference, the impression roller 31 has an insulation layer 32, as well as a (semi-) conductive layer 33 on the circumference of the insulation layer 32. The impression roller 31 is hence designed like the pressure roller in FIG. 2*a*.

A charging electrode 28 which, for example, is designed as a needle electrode is arranged at a distance from the impression roller 31 parallel to its rotary axis. The charging electrode 28 is connected by an electric line and a switching apparatus to a positive and negative high-voltage generator.

The web material 12 is fed to the winding roller 15 by the idler roller 30 and the impression roller 31. The impression roller 31 presses the web material 12 against the winding roller 15. In so doing, the (semi-) conductive layer 33 of the impression roller 31 is charged by the charging electrode 28 so that existing charges in the web material 12 are compensated, or respectively the web material 12 is discharged. Consequently, the web material 12 can be wound onto the winding roller 15 without undesirable charges.

Figure 5:
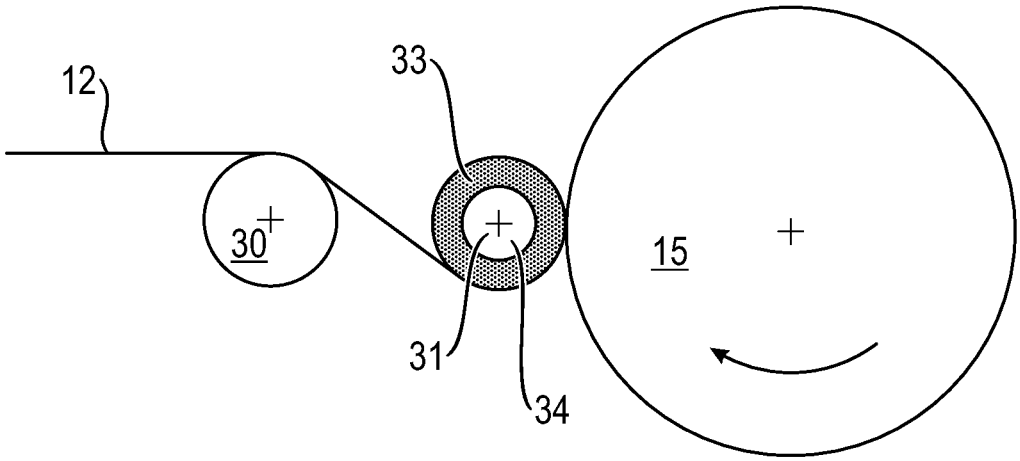
FIG. 5 shows an alternative winding device according to the invention with a winding roller with a core charging system.

The exemplary embodiment in FIG. 5 differs from the above-described in that the impression roller 31 has an electrically conductive core 34 and a (semi-) conductive layer 33 on the circumference. An electric charge is supplied to the core 34 by a core charging system. By means of this measure, charges in the web material 12 are compensated, or respectively discharged, and consequently the web material on the winding roller 15 does not contain any undesirable charges.

The invention claimed is:

1. A winding device for a substantially electrically insulating web material having a winding roller on which the web material can be wound, characterized in that an apparatus exists for transferring an electric charge to the web material on the winding roller, and when deflecting to the winding roller, and the apparatus for transferring an electric charge is connected to at least one electrical high-voltage source with a positive or negative polarity such that undesirable charge on the web material on the winding roller is reduced or avoided, wherein the winding device has an impression roller which deflects the web material to the winding roller and lies against the web material on the circumference of the winding roller in order to roll against it in the direction opposite that of the winding roller, wherein the impression roller has an electrically conductive layer or electrically semi-conductive layer on the circumference, an apparatus exists for transferring an electric charge to the electrically conductive layer or electrically semi-conductive layer of the impression roller, and the apparatus for transferring an electric charge to the conductive layer or electrically semi-conductive layer is connected to the electrical high-voltage source.

2. The winding device according to claim 1, wherein the apparatus for transferring an electric charge to the web material is a charging electrode that is connected to the electrical high-voltage source.

3. The winding device according to claim 1 which has an idler roller that is arranged at a distance from the winding roller which has a rotary axis that is arranged parallel to the rotary axis of the idler roller so that the web material is guided by the idler roller to the circumference of an impression roller, deflected by the impression roller, and guided on the circumference of the winding roller.

4. The winding device according to claim 1, wherein the apparatus for transferring an electric charge to the web material is connected by a switching apparatus to a high-voltage source with a positive polarity, and a high-voltage source with negative polarity.

5. The winding device according to claim 1, wherein the high-voltage source supplies an adjustable high voltage.

6. The winding device according to claim 1, wherein at least one field strength measuring device is arranged so that it detects the web material on the winding roller and/or while being deflected to the winding roller, wherein the field strength measuring device measures the charge that the web material has and is connected to at least one control apparatus that is connected to the high-voltage source and/or the switching apparatus in order to apply a high-voltage of a specific level and/or polarity, depending on the charge of the web material measured by the field strength measuring device, to an impression roller.

7. The winding device according to claim 1, wherein a control apparatus is designed so that it applies a high-voltage at a level and/or polarity to an impression roller which causes a minimum charging of the web material wound on the winding roller.

8. The winding device according to claim 1 that is a winding device of a rotary printing press.

9. A winding device for a substantially electrically insulating web material having a winding roller on which the web material can be wound, characterized in that an apparatus exists for transferring an electric charge to the web material on the winding roller, and when deflecting to the winding roller, and the apparatus for transferring an electric charge is connected to at least one electrical high-voltage source with a positive or negative polarity such that undesirable charge on the web material on the winding roller is reduced or avoided, wherein the winding device has an impression roller which deflects the web material to the winding roller and lies against the web material on the circumference of the winding roller in order to roll against it in the direction opposite that of the winding roller, wherein the impression roller has an electrically conductive layer or electrically semi-conductive layer on the circumference, an apparatus exists for transferring an electric charge to the electrically conductive layer or electrically semi-conductive layer of the impression roller, and the apparatus for transferring an electric charge to the conductive layer or electrically semi-conductive layer is connected to the electrical high-voltage source, and wherein the winding device has an idler roller that is arranged at a distance from the winding roller which has a rotary axis that is arranged parallel to the rotary axis of the idler roller, so that the web material is guided by the idler roller to the circumference of the impression roller, deflected by the impression roller, and guided on the circumference of the winding roller.

* * * * *